US009860643B1

(12) United States Patent
Oswald

(10) Patent No.: US 9,860,643 B1
(45) Date of Patent: Jan. 2, 2018

(54) AUDIO SYSTEMS AND METHOD FOR ACOUSTIC ISOLATION

(71) Applicant: BOSE CORPORATION, Framingham, MA (US)

(72) Inventor: Charles Oswald, Salem, NY (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 15/360,074

(22) Filed: Nov. 23, 2016

(51) Int. Cl.

| | |
|---|---|
| ***G10K 11/16*** | (2006.01) |
| ***H04R 3/14*** | (2006.01) |
| ***H04R 29/00*** | (2006.01) |
| ***G10K 11/175*** | (2006.01) |
| ***H04R 3/04*** | (2006.01) |

(52) U.S. Cl.
CPC ..... *H04R 3/14* (2013.01); *G10K 11/175* (2013.01); *H04R 3/04* (2013.01); *H04R 29/001* (2013.01); *G10K 2210/1282* (2013.01); *H04R 2420/01* (2013.01)

(58) Field of Classification Search
CPC ..... H04R 3/14; H04R 3/04; H04R 29/001; G10K 11/175
See application file for complete search history.

(56) References Cited

U.S. PATENT DOCUMENTS

| | | | | |
|---|---|---|---|---|
| 8,325,936 | B2 | 12/2012 | Eichfeld et al. | |
| 9,100,748 | B2 | 8/2015 | Hartung et al. | |
| 9,100,749 | B2 | 8/2015 | Hartung et al. | |
| 2008/0273723 | A1* | 11/2008 | Hartung ..... | H04R 1/403 381/302 |
| 2017/0053636 | A1 | 2/2017 | Oswald et al. | |

* cited by examiner

*Primary Examiner* — Simon King
(74) *Attorney, Agent, or Firm* — Lando & Anastasi, LLP

(57) ABSTRACT

Audio systems and methods for providing acoustic isolation. In one example, an audio system includes an audio source, a first speaker positioned proximate a first seating position, a second speaker positioned proximate a second seating position, the second speaker configured to provide acoustic energy to the second seating position based on an audio signal from the audio source, a third speaker positioned proximate a third seating position, the third speaker configured to provide acoustic energy to the third seating position, during a first mode of operation, and at least one cancellation filter interposed between the audio source and the third speaker, the at least one cancellation filter configured to provide a filtered audio signal to the third speaker, during a second mode of operation, to cancel at the first seating position at least a portion of the acoustic energy provided by the second speaker.

24 Claims, 6 Drawing Sheets

AUDIO SYSTEMS AND METHOD FOR ACOUSTIC ISOLATION

TECHNICAL FIELD

Aspects and implementations of the present disclosure are directed generally to audio systems, and in some examples, more specifically to audio systems for providing acoustic isolation in a vehicle.

BACKGROUND

Traditionally, vehicle audio systems deliver an audio signal to speakers positioned in the perimeter surfaces of a passenger compartment of a vehicle, such as the doors or a dashboard of the vehicle. The audio signal supplied by a vehicle radio (or other signal source) is amplified, processed, and corresponding acoustic energy is delivered through the speakers to convey audio content to an occupant of the vehicle. Typical vehicle audio systems deliver common audio content to all passengers of the vehicle, irrespective of passenger occupancy within the vehicle.

SUMMARY

In accordance with an aspect of the present disclosure, there is provided an audio system including near-field speakers arranged at a plurality of seating positions within a vehicle. Specifically, at least one of the near-field speakers is operable to substantially reduce acoustic energy leaked to an undesirable location from another near-field speaker. Such aspects and implementations are particularly advantageous when included in vehicles having at least two rows of seats, where acoustic energy from a near-field speaker proximate a seat in the rear of the vehicle may be undesirably leaked to a seat in the front of the vehicle (or vice versa).

Specifically, the audio system may include at least one near-field speaker positioned near a first seat in the rear of the vehicle which is operable to focus cancelling acoustic energy at a seating position in the front of the vehicle to substantially cancel leaked acoustic energy from another near-field speaker positioned in the rear of the vehicle. Accordingly, each near-field speaker may be dynamically reconfigured between a first mode of operation, during which that near-field speaker provides acoustic energy to a proximate seating position, and a second mode of operation, during which that near-field speaker provides acoustic isolation functionality (e.g., noise reduction) at another seating position.

According to one aspect, provided is an audio system. In one example, the audio system includes at least one audio signal source, a first near-field speaker coupled to the at least one audio signal source and positioned proximate a first seating position, a second near-field speaker coupled to the at least one audio signal source and positioned proximate a second seating position, the second near-field speaker being configured to provide acoustic energy to the second seating position based on an audio signal provided by the at least one audio signal source, a third near-field speaker coupled to the at least one audio signal source and positioned proximate a third seating position, the third near-field speaker being configured to provide acoustic energy to the third seating position based on the audio signal provided by the at least one audio signal source, during a first mode of operation, and at least one cancellation filter interposed between the at least one audio signal source and the third near-field speaker, the at least one cancellation filter being configured to provide a filtered audio signal to the third near-field speaker, during a second mode of operation, to cancel at the first seating position at least a portion of the acoustic energy provided by the second near-field speaker.

In one example, the audio system further includes at least one sensor positioned to detect at least one of a vacancy and an occupancy of the third seating position and provide a corresponding occupancy signal, and control circuitry coupled to the at least one sensor and configured select between the first mode of operation and the second mode of operation based at least in part on the occupancy signal. According to certain examples, the control circuitry is configured to dynamically switch between the first mode of operation and the second mode of operation based on the detected vacancy of the third seating position, and the control circuitry is configured to dynamically switch between the second mode of operation and the first mode of operation based on the detected occupancy of the third seating position.

According to one example, in the second mode of operation, the third near-field speaker is configured to receive the filtered audio signal and radiate cancelling acoustic energy such that the acoustic energy provided by the second near-field speaker and the cancelling acoustic energy destructively interfere at the first seating position. In one example, the at least one cancellation filter includes at least one linear and time-invariant filter defined by a transfer function. According to one example, the acoustic energy provided by the second near-field speaker includes at least a high frequency portion and a low frequency portion, and the canceled portion of the acoustic energy provided by the second near-field speaker is the low frequency portion.

In some examples, the at least one cancellation filter is configured such that, in the second mode of operation, the third near-field speaker does not produce acoustic energy in a high frequency range associated with the high frequency portion.

According to certain examples, the first seating position is located within a first audio content zone, the second seating position is located within a second audio content zone, and the third seating position is located within the second audio content zone, and the second audio content zone is within one of a forward-facing direction or rearward-facing direction of the first audio content zone. In one example, the first seating position includes a first seat within a vehicle, the second seating position includes a second seat within the vehicle, and the third seating position includes a third seat within the vehicle.

In one example, the first seat includes a driver's seat positioned within a first row of seats of the vehicle, the second seat includes a first rear passenger's seat positioned within a second row of seats of the vehicle, and the third seat includes a second rear passenger's seat positioned within the second row of seats of the vehicle. According to one example, the first seat includes a first rear passenger's seat positioned within a second row of seats of the vehicle, the second seat includes a front passenger's seat positioned within a first row of seats of the vehicle, and the third seat includes a driver's seat positioned within the first row of seats of the vehicle.

According to an aspect, provided is an audio system. In one example, the audio system includes a first audio signal source, a first near-field speaker coupled to the audio signal source and positioned within a first audio content zone, a second audio signal source, a second near-field speaker and a third near-field speaker each coupled to the second audio signal source and positioned within a second audio content zone, the second near-field speaker being configured to provide acoustic energy to the second audio content zone based on an audio signal provided by the second audio signal source, at least one sensor positioned to detect a vacancy of a first seating position within the second audio content zone and proximate the third near-field speaker, and at least one cancellation filter interposed between the second audio signal source and the third near-field speaker, the at least one cancellation filter being configured to provide a filtered audio signal to the third near-field speaker to cancel within the first audio content zone at least a portion of the acoustic energy provided by the second near-field speaker, responsive to detection of the vacancy by the at least one sensor.

In one example, the at least one sensor is further configured to detect an occupancy of the first seating position, and the third near-field speaker is further configured to provide acoustic energy to the second audio content zone based on the audio signal provided by the second audio signal source, responsive to detection of the occupancy by the at least one sensor. According to an example, the first near-field speaker is configured to provide acoustic energy to the first audio content zone based on the audio signal provided by the first audio signal source, and the audio signal provided by the first audio signal source is different from the second audio signal provided by the second audio signal source.

According to certain examples, the audio system further includes control circuitry coupled to the at least one sensor and configured to select between a first mode of operation and a second mode of operation based on the detected vacancy or the detected occupancy, where in the first mode of operation the third near-field speaker is configured to provide the acoustic energy to the second audio content zone, and in the second mode of operation the third near-field speaker is configured to provide cancelling acoustic energy such that the acoustic energy provided by the second near-field speaker and the cancelling acoustic energy destructively interfere within the first audio content zone.

In one example, the acoustic energy provided by the second near-field speaker includes at least a high frequency portion and a low frequency portion, and the canceled portion of the acoustic energy provided by the second near-field speaker is the low frequency portion. According to one example, the at least one cancellation filter is configured to provide the filtered audio signal to the third near-field speaker to cancel, at a second seating position within the first audio content zone, the portion of the acoustic energy provided by the second near-field speaker, and the second seating position includes a vehicle seat positioned within a first row of seats of a vehicle. In one example, the at least one cancellation filter is configured to provide the filtered audio signal to the third near-field speaker to cancel, at a second seating position within the first audio content zone, the portion of the acoustic energy provided by the second near-field speaker, and the second seating position includes a vehicle seat positioned within a second row of seats of a vehicle.

According to an aspect, provided is a method of operating an audio system. In one example, the method includes providing an audio signal, responsive to receiving the audio signal at a first near-field speaker, providing acoustic energy from the first near-field speaker to a first seating position, selecting between a first mode of operation and a second mode of operation, providing acoustic energy from a second near-field speaker to a second seating position positioned proximate the second near-field speaker, during the first mode of operation, and cancelling, at a third seating position, at least a portion of the acoustic energy emitted from the first near-field speaker based at least in part on a filtered audio signal provided to the second near-field speaker, during the second mode of operation.

In one example, cancelling the at least a portion of the acoustic energy emitted from the first near-field speaker includes providing cancelling acoustic energy from the second near-field speaker such that the acoustic energy provided by the first near-field speaker and the cancelling acoustic energy destructively interfere, at the third seating position. According to one example, the acoustic energy provided by the first near-field speaker includes at least a high frequency portion and a low frequency portion, and cancelling the at least a portion of the acoustic energy emitted from the first near-field speaker includes cancelling the low frequency portion.

According to one example, the method further includes detecting at least one of a vacancy and an occupancy of the second seating position, and providing a corresponding occupancy signal, and the selection between the first mode of operation and the second mode of operation is based at least in part on the occupancy signal. In one example, selecting between the first mode of operation and the second mode of operation includes dynamically switching between the first mode of operation and the second mode of operation based on the detected vacancy of the second seating position. According to one example, selecting between the first mode of operation and the second mode of operation includes dynamically switching between the second mode of operation and the first mode of operation based on the detected occupancy of the second seating position.

Still other aspects, examples, and advantages of these exemplary aspects and examples are discussed in detail below. Examples disclosed herein may be combined with other examples in any manner consistent with at least one of the principles disclosed herein, and references to "an example," "some examples," "an alternate example," "various examples," "one example" or the like are not necessarily mutually exclusive and are intended to indicate that a particular feature, structure, or characteristic described may be included in at least one example. The appearances of such terms herein are not necessarily all referring to the same example. Various aspects and examples described herein may include means for performing any of the described methods or functions.

BRIEF DESCRIPTION OF THE DRAWINGS

Various aspects of at least one example are discussed below with reference to the accompanying figures, which are not intended to be drawn to scale. The figures are included to provide illustration and a further understanding of the various aspects and examples, and are incorporated in and constitute a part of this specification, but are not intended as a definition of the limits of the disclosure. In the figures, each identical or nearly identical component that is illustrated in various figures is represented by a like numeral. For purposes of clarity, not every component may be labeled in every figure. In the figures.

DETAILED DESCRIPTION

Figure 1:
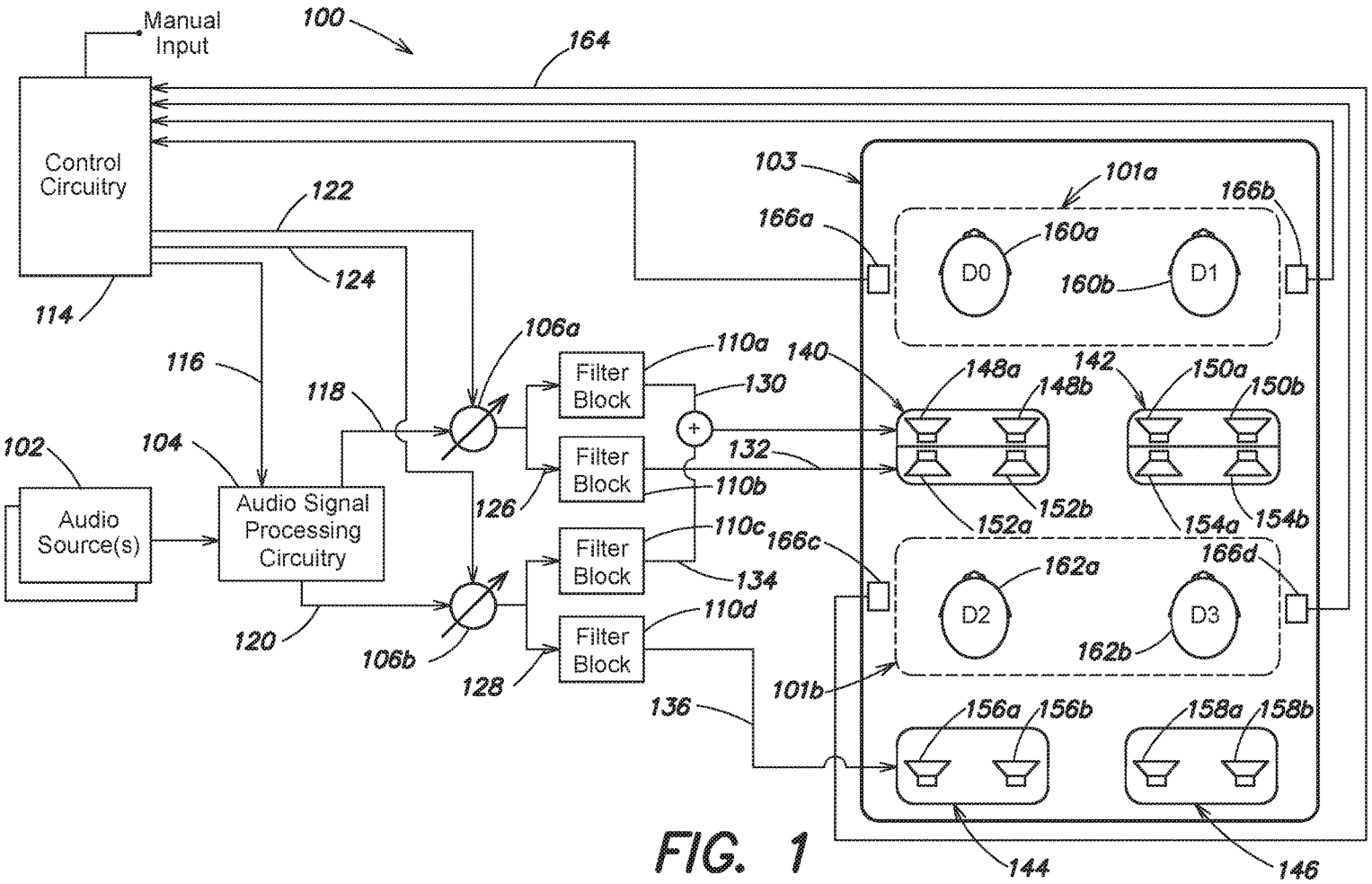
FIG. 1 is a schematic view of an example vehicle audio system according to aspects of the disclosure.

In accordance with an aspect of the present disclosure, there is provided an audio system including near-field speakers arranged at a plurality of seating positions. Specifically, at least one of the near-field speakers is operable to substantially reduce acoustic energy provided by another of the plurality of near-field speakers and leaked to an undesirable location. In one example, at least one of the near-field speakers may be positioned proximate a first seating position, and may be controlled to substantially reduce the acoustic energy leaked by another near-field speaker and received at a second seating position. Certain examples of the near-field speakers discussed herein may be operable between at least a first mode of operation, during which the near-field speaker provides acoustic energy to a corresponding proximate seating position, and a second mode of operation, during which the near-field speaker provides functionality for an improved listening experience (e.g., noise cancellation) at another seating position. In at least these examples, a detected occupancy or vacancy of the corresponding seating position may prompt reconfiguration between the first mode of operation and the second mode of operation, or vice versa.

According to certain implementations, the audio system may include a near-field speaker positioned in a rear of a vehicle, which may be controlled to cancel acoustic energy leaked by another near-field speaker in the rear of the vehicle to a seating position in a front of the vehicle. In similar implementations, the audio system may include a near-field speaker positioned in the front of the vehicle, which may be controlled to cancel acoustic energy leaked by another near-field speaker in the front of the vehicle to a seating position in the rear of the vehicle. While at least one advantage of the audio system discussed herein includes improved acoustic isolation, various other benefits and advantages are discussed with reference to the examples and implementations described below.

Though the elements of several views of the drawings herein may be shown and described as discrete elements in a block diagram and may be referred to as "circuitry," unless otherwise indicated, the elements may be implemented as one of, or a combination of, analog circuitry, digital circuitry, or one or more microprocessors executing software instructions. For example, the software instructions may include digital signal processing (DSP) instructions. Unless otherwise indicated, signal lines may be implemented as discrete analog or digital signal lines, as a single discrete digital signal line with appropriate signal processing to process separate streams of audio signals, or as elements of a wireless communication system. Some of the processing operations may be expressed in terms of the calculation and application of coefficients. The equivalent of calculating and applying coefficients can be performed by other analog or digital signal processing techniques and are included within the scope of this disclosure. Unless otherwise indicated, audio signals may be encoded in either digital or analog form; conventional digital-to-analog or analog-to-digital converters may not be shown in the figures.

It is to be appreciated that examples of the methods and apparatuses discussed herein are not limited in application to the details of construction and the arrangement of components set forth in the following description or illustrated in the accompanying drawings. The methods and apparatuses are capable of implementation in other examples and of being practiced or of being carried out in various ways. Examples of specific implementations are provided herein for illustrative purposes only and are not intended to be limiting. Also, the phraseology and terminology used herein is for the purpose of description and should not be regarded as limiting. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Any references to front and back, left and right, top and bottom, upper and lower, and vertical and horizontal are intended for convenience of description, not to limit the present systems and methods or their components to any one positional or spatial orientation.

Acoustic cancellation (e.g., cross-talk cancellation) can be utilized in combination with near-field speakers to provide discrete audio content zones at different seating positions within a listening area, such as a vehicle cabin. "Near-field speakers" may include speakers located near a head position of an occupant of a corresponding seating position. FIG. 1 illustrates an exemplary implementation of a vehicle audio system 100 that incorporates a number of cross-talk cancellation filters in combination with a plurality of headrest mounted near-field speakers to provide two discrete (front and rear) audio content zones 101*a*, 101*b* within a vehicle cabin 103. While shown in the example of FIG. 1 as an audio system configured for installation within the vehicle cabin 103, in various other implementations, the audio system 100 may be configured for installation in other spaces having more than one seating position, such as theaters, amusement park rides, and auditoriums, to name a few.

As illustrated in FIG. 1, the system 100 may include one or more audio signal sources 102 that are coupled to audio signal processing circuitry 104. The audio signal processing circuitry 104 is coupled to front and rear volume adjustment circuitry 106*a*, 106*b*, respectively. The front and rear volume adjustment circuitry 106*a*, 106*b* is coupled to the near-field speakers via cancellation filter blocks, which may include the cross-talk cancellation filter blocks 110*a-d*. While in one implementation, each near-field speaker may be located within the headrest of the seat of a corresponding seating position, as illustrated in the example system 100 of FIG. 1, in other implementations, each near-field speaker may be located coextensive with an exterior of the associated headrest, or in any other suitable position near the seating position and proximate to the head of the occupant (e.g., occupants D0, D1, D2, D3).

In response to control information received from a user through manual input, a control circuit 114 sends a signal 116 to the audio signal processing circuitry 104 selecting a given audio source for the front and rear audio content zones 101*a*, 101*b*. That is, the signal identifies which audio source is selected for each of the audio content zones. Each audio content zone can select a different audio source, or a common audio source may be selected for both of the front and rear audio content zones 101*a*, 101*b*. In certain examples, the audio signal processing circuitry 104 delivers a first audio signal 118 representing audio content for the front zone 101*a* to the front volume adjustment circuitry 106*a*, and delivers a second audio signal 120 representing audio content for the rear zone 101*b* to the rear volume adjustment circuitry 106*b*. In various examples, the first audio signal 118 is different from the second audio signal 120.

In response to volume control information received from a user through manual input, the control circuit sends first and second volume control signals 122, 124 to the front and rear volume adjustment circuitry 106*a*, 106*b*, respectively. The front and rear volume adjustment circuitry 106*a*, 106*b* adjust the respective amplitudes of the first and second audio signals 118, 120 in response to the volume control signals 122, 124 and provide the amplitude adjusted audio signals 126, 128 to the cross-talk cancellation filter blocks 110*a-d*. In that regard, the front volume adjustment circuitry 106*a* controls volume of audio content presented in the front audio content zone 101*a*, and the rear volume adjustment circuitry 106*b* operates to control the volume of audio content presented in the rear audio content zone 101*b*. Consequently, even when the same audio content is selected for presentation in both zones, the volume level may still differ between the zones.

In the illustrated example, the front volume adjustment circuitry 106*a* provides a first amplitude adjusted audio signal 126 to first and second cross-talk cancellation filter blocks 110*a*, 110*b*, and the rear volume adjustment circuitry 106*b* provides a second amplitude adjusted audio signal 128 to third and fourth cross-talk cancellation filter blocks 110*c*, 110*d*. Each of the filter blocks 110*a-d* includes a plurality of cross-talk cancellation filters which may be implemented as least-squares (LS) filters. In certain examples, each cancellation filter may include a linear and time-invariant filter defined by a transfer function. The filter transfer functions for the cross-talk cancellation filters may be determined according to:

$$G=H^{-1}$$

where,

G is a matrix representing the filter transfer functions which are solved;

H is a matrix representing the measured acoustic transfer functions, and $H^{-1}$ is the pseudo inversion of that matrix.

The filters transfer functions, G, coupled with the acoustic transfer functions of the system, H, create a cross-talk cancellation system.

Regarding the example illustrated in FIG. 1, the filter transfer functions for the cross-talk cancellation filters in the first and second filter blocks 110*a*, 110*b* may be solved for together since, in certain examples, those two filter blocks work together to provide cross-talk cancellation at front seating positions 160*a*, 160*b* and to cancel audio from the front zone 101*a* at the rear seating positions 162*a*, 162*b*. Similarly, the filter transfer functions for the cross-talk cancellation filters in the third and fourth filter blocks 110*c*, 110*d* may be solved for together since those two filter blocks may work together to provide cross-talk cancellation at the rear seating positions 162*a*, 162*b* and to cancel audio from the rear zone 101*b* at the front seating positions 160*a*, 160*b*. The cross-talk cancellation filter blocks 110*a-d* provide respective filtered audio signals 130, 132, 134, 136 to corresponding sets of the near-field speakers which transduce the filtered audio signals 130, 132, 134, 136 to provide acoustic energy and deliver audio content.

As illustrated in FIG. 1, the system 100 may include a pair of front headrests 140, 142 and a pair of rear headrests 144, 146. In the illustrated example, each of the front headrests is provided with four electro-acoustic transducers including two forward firing electro-acoustic transducers (e.g., near-field speakers 148*a*, 148*b*, 150*a*, 150*b*) and two rear firing electro-acoustic transducers (e.g., near-field speakers 152*a*, 152*b*, 154*a*, 154*b*). The forward firing speakers 148*a*, 148*b*, 150*a*, 150*b* of the front headrests 140, 142 provide audible audio content for the occupants D0, D1 in front audio content zone 101*a* (i.e., the two front seating positions 160*a*, 160*b*), while also assisting in enabling inter-aural cross-talk cancellation in each of the two front seating positions 160*a*, 160*b*, and inter-seat cross-talk cancellation between the first seating position 160*a* and the second seating position 160*b*. The rear firing speakers 152*a*, 152*b*, 154*a*, 154*b* of the front headrests 144, 146 assist in enabling inter zone cross-talk cancellation between the front and rear audio content zones 101*a*, 101*b*.

Each of the rear headrests 144, 146 include two forward firing speakers (e.g., near-field speakers 156*a*, 156*b*, 158*a*, 158*b*). The forward firing speakers 156*a*, 156*b*, 158*a*, 158*b* of the rear headrests 144, 146 provide audible audio content for the occupants in the rear audio content zone 101*b* (i.e., the two rear seating positions 162*a*, 162*b*), while also assisting in enabling inter-aural cross-talk cancellation in each of the two rear seating positions 162*a*, 162*b*, and inter-seat cross-talk cancellation between the third seating position 162*a* and the fourth seating position 162*b*. Operation, in this manner, of the forward firing speakers 148*a*, 148*b*, 150*a*, 150*b* of the front headrests 140, 142, the rear firing speakers 152*a*, 152*b*, 154*a*, 154*b* of the front headrests 140, 142, and the forward firing speakers 156*a*, 156*b*, 158*a*, 158*b* of the rear headrests 144, 146 is referred to herein as a first mode of operation of the corresponding near-field speaker.

Figure 2A:
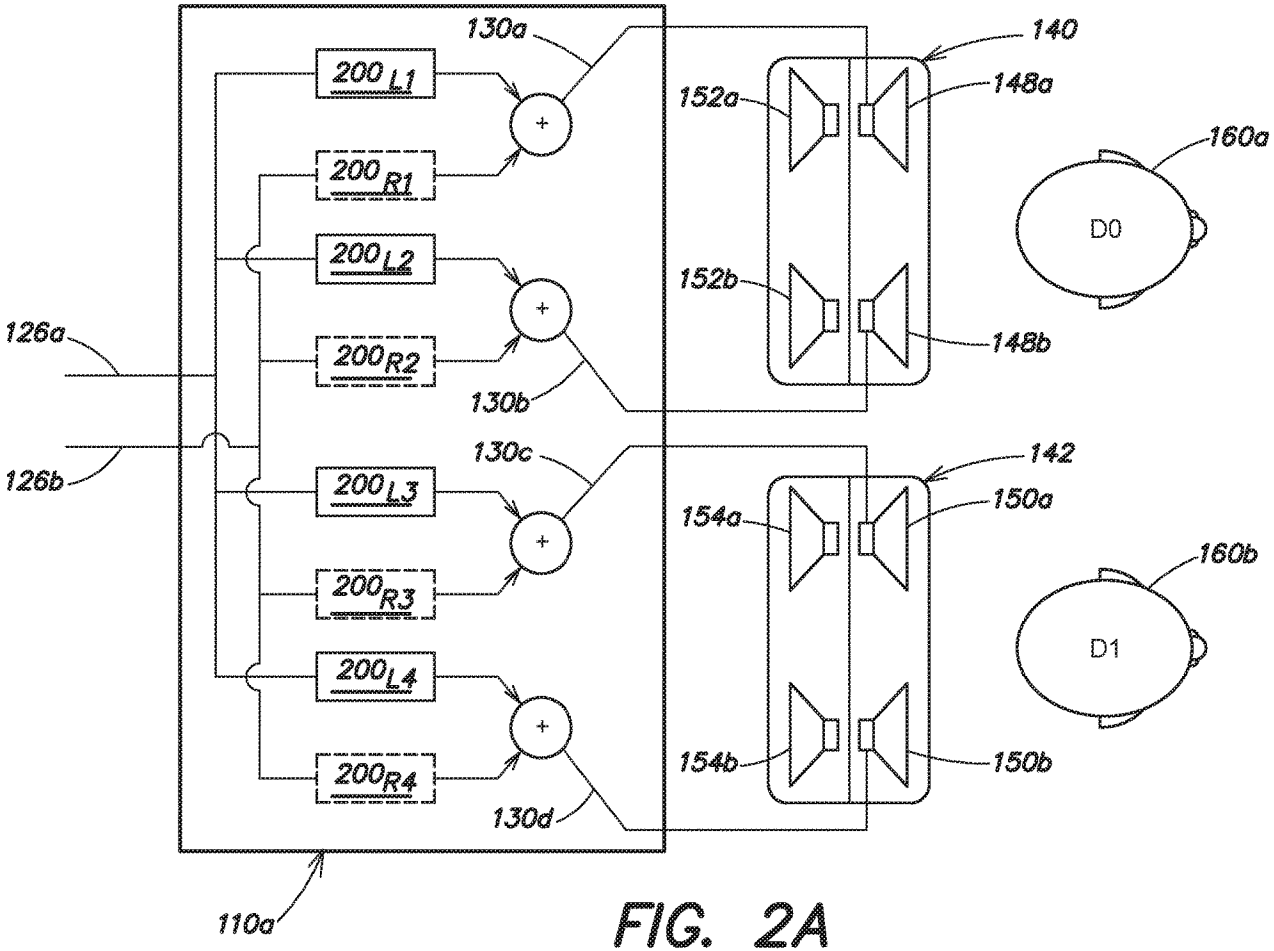
FIGS. 2A-2D are schematic views of cancellation filter blocks and associated headrest mounted near-field speakers from the vehicle audio system of FIG. 1, according to aspects of the disclosure.

Referring to FIG. 2A, with continuing reference to FIG. 1, the first cross-talk cancellation filter block 110*a* includes a plurality of cross-talk cancellation filters (eight shown). The first amplitude adjusted audio signal 126, shown as a stereo audio signal including left and right audio channels 126*a*, 126*b*, is passed through the first cross-talk cancellation filter block 110*a* to produce first filtered audio signals 130*a-d* (collectively referenced as 130), one for each of the forward firing near-field speakers 148*a*, 148*b*, 150*a*, 150*b* in the front headrests 140, 142. Each filtered audio signal 130 determines the net acoustic energy associated with each acoustic channel in the first audio signal 118 that is provided to the occupants D0, D1 in the corresponding seating positions 160*a*, 160*b*.

A left channel filter $\mathbf{200}_{L1}$ associated with a forward firing left speaker 148*a* of the headrest 140 modifies the left channel input signal 126*a* taking into account the acoustic transfer functions from each of the other front headrest mounted speakers 148*b*, 150*a*, 150*b*, 152*a*, 152*b*, 154*a*, 154*b* to an expected position of the occupant D0's left ear to produce a first output signal component that is configured to reproduce the left channel audio content of the first audio signal at the occupant D0's left ear.

A right channel filter $\mathbf{200}_{R1}$ associated with the forward firing left speaker 148*a* of the driver's headrest 140 modifies the right channel input 126*b* of the first amplitude adjusted audio signal 126 taking into account the transfer functions from each of the other front headrest mounted speakers 148*b*, 150*a*, 150*b*, 152*a*, 152*b*, 154*a*, 154*b* to the expected position of the occupant D0's left ear to produce a second output signal component that is configured to cancel the right channel audio content of the first audio signal 118 that is leaked to the occupant D0's left ear from the other speakers 148*b*, 150*a*, 150*b*, 152*a*, 152*b*, 154*a*, 154*b* in the front headrests 140, 142.

The first and second output signal components are combined to produce a filtered audio signal 130*a* which is provided to the forward firing left speaker 148*a* in the headrest 140. The remaining cross-talk cancellation filters of the first cross-talk cancellation filter block 110*a* and the associated speakers 148*b*, 150*a*, 150*b* operate similarly so that the front audio content zone 101*a* occupants D0, D1 hear only left audio content of the first audio signal 118 at their respective left ears and hear only right audio content of the first audio signal 118 at their respective right ears.

In certain examples, filters $\mathbf{200}_{L2}$ and $\mathbf{200}_{R2}$ provide a filtered audio signal 130*b* to the forward firing right speaker 148*b* in the headrest 140, which is transduced to reproduce the right channel audio content of the first audio signal 118 at the occupant D0's right ear, while cancelling left channel content of the first audio signal 118 leaked by the other front headrest mounted speakers 148*a*, 150*a*, 150*b*, 152*a*, 152*b*, 154*a*, 154*b* at the occupant D0's right ear.

Filters $\mathbf{200}_{L3}$ and $\mathbf{200}_{R3}$ provide a filtered audio signal 130*c* to the forward firing left speaker 150*a* in the headrest 142, which is transduced to reproduce the left channel audio content of the first audio signal 118 at the occupant D1's left ear, while cancelling right channel content of the first audio signal 118 leaked by the other front headrest mounted speakers 148*a*, 148*b*, 150*b*, 152*a*, 152*b*, 154*a*, 154*b* at the occupant D1's left ear.

Similarly, filters $\mathbf{200}_{L4}$ and $\mathbf{200}_{R4}$ provide a filtered audio signal 130*d* to the forward firing right speaker 150*b* in the headrest 142, which is transduced to reproduce the right channel audio content of the first audio signal 118 at the occupant D1's right ear, while cancelling left channel content of the first audio signal 118 leaked by the other front headrest mounted speakers 148*a*, 148*b*, 150*a*, 152*a*, 152*b*, 154*a*, 154*b* at the occupant D1's right ear.

Figure 2B:
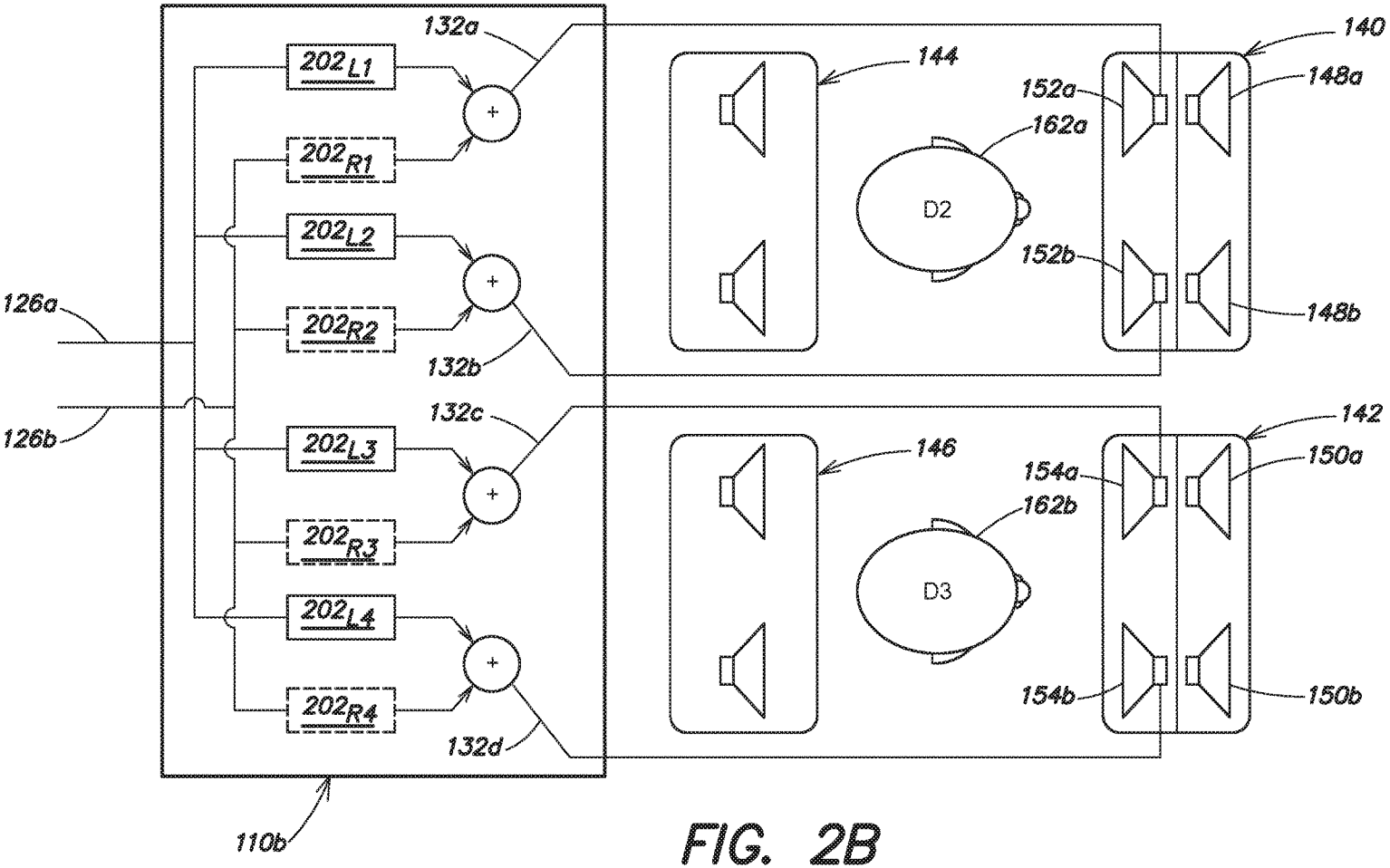

Referring to FIG. 2B, with continuing reference to FIG. 1 the second cross-talk cancellation filter block 110*b* includes a plurality of cross-talk cancellation filters (eight shown). The first amplitude adjusted audio signal 126, shown again as a stereo audio signal including left and right audio channels 126*a*, 126*b*, is passed through the second cross-talk cancellation filter block 110*b* to produce second filtered audio signals 132*a-d* (collectively referenced as 132), one for each of the rear firing near-field speakers 152*a*, 152*b*, 154*a*, 154*b* in the front headrests 140, 142. These filtered audio signals 132 determine the net acoustic energy associated with each acoustic channel in the first audio signal 118 that is provided to the occupants D2, D3 in the rear seating positions 162*a*, 162*b*.

A left channel filter $\mathbf{202}_{L1}$ associated with a rear firing left speaker 152*a* of the headrest 140 modifies the left channel input signal 126*a* taking into account the acoustic transfer functions from each of the other front headrest mounted speakers 148*a*, 148*b*, 150*a*, 150*b*, 152*b*, 154*a*, 154*b* to an expected position of the occupant D2's left ear to produce a first output signal component that is configured to cancel the left channel audio content of the first audio signal 118 that is leaked to the occupant D2's left ear from the other front headrest mounted speakers 148*a*, 148*b*, 150*a*, 150*b*, 152*b*, 154*a*, 154*b*.

A right channel filter $\mathbf{202}_{R1}$ associated with the rear firing left speaker 152*a* of the headrest 140 modifies the right channel input from first amplitude adjusted audio signal 126*b* taking into account the acoustic transfer functions from each of the other front headrest mounted speakers 148*a*, 148*b*, 150*a*, 150*b*, 152*b*, 154*a*, 154*b* to the expected position of the occupant D2's left ear to produce a second output signal component that is configured to cancel the right channel audio content of the first audio signal 118 that is leaked to the occupant D2's left ear from the other front headrest mounted speakers 148*a*, 148*b*, 150*a*, 150*b*, 152*b*, 154*a*, 154*b*.

The first and second output signal components are combined to produce a filtered audio signal 132*a* which is provided to the rear firing left speaker 152*a* in the headrest 140. The remaining cross-talk cancellation filters of the second cross-talk cancellation filter block 110*b* and the associated near-field speakers 152*b*, 154*a*, 154*b* operate similarly so that audio content from the first audio signal 118 is cancelled at the seating positions 162*a*, 162*b* in the rear audio content zone 101*b* (FIG. 1).

Filters $\mathbf{202}_{L2}$ and $\mathbf{202}_{R2}$ provide a filtered audio signal 132*b* to the rear firing right speaker 152*b* in the 140, which is transduced to cancel audio content of the first audio signal 118 leaked by the other front headrest mounted speakers 148*a*, 148*b*, 150*a*, 150*b*, 152*a*, 154*a*, 154*b* at the occupant D2's right ear.

Filters $\mathbf{202}_{L3}$ and $\mathbf{202}_{R3}$ provide a filtered audio signal 132*c* to the rear firing left speaker 154*a* in the headrest 142, which is transduced to cancel audio content of the first audio signal 118 leaked by the other front headrest mounted speakers 148*a*, 148*b*, 150*a*, 150*b*, 152*a*, 152*b*, 154*b* at the occupant D3's left ear.

Filters $\mathbf{202}_{L4}$ and $\mathbf{202}_{R4}$ provide a filtered audio signal 132*d* to the rear firing right speaker 154*b* in the occupant D1's headrest 142, which is transduced to cancel audio content of the first audio signal 118 leaked by the other front headrest mounted speakers 148*a*, 148*b*, 150*a*, 150*b*, 152*a*, 152*b*, 154*a* at the occupant D3's right ear.

Figure 2C:
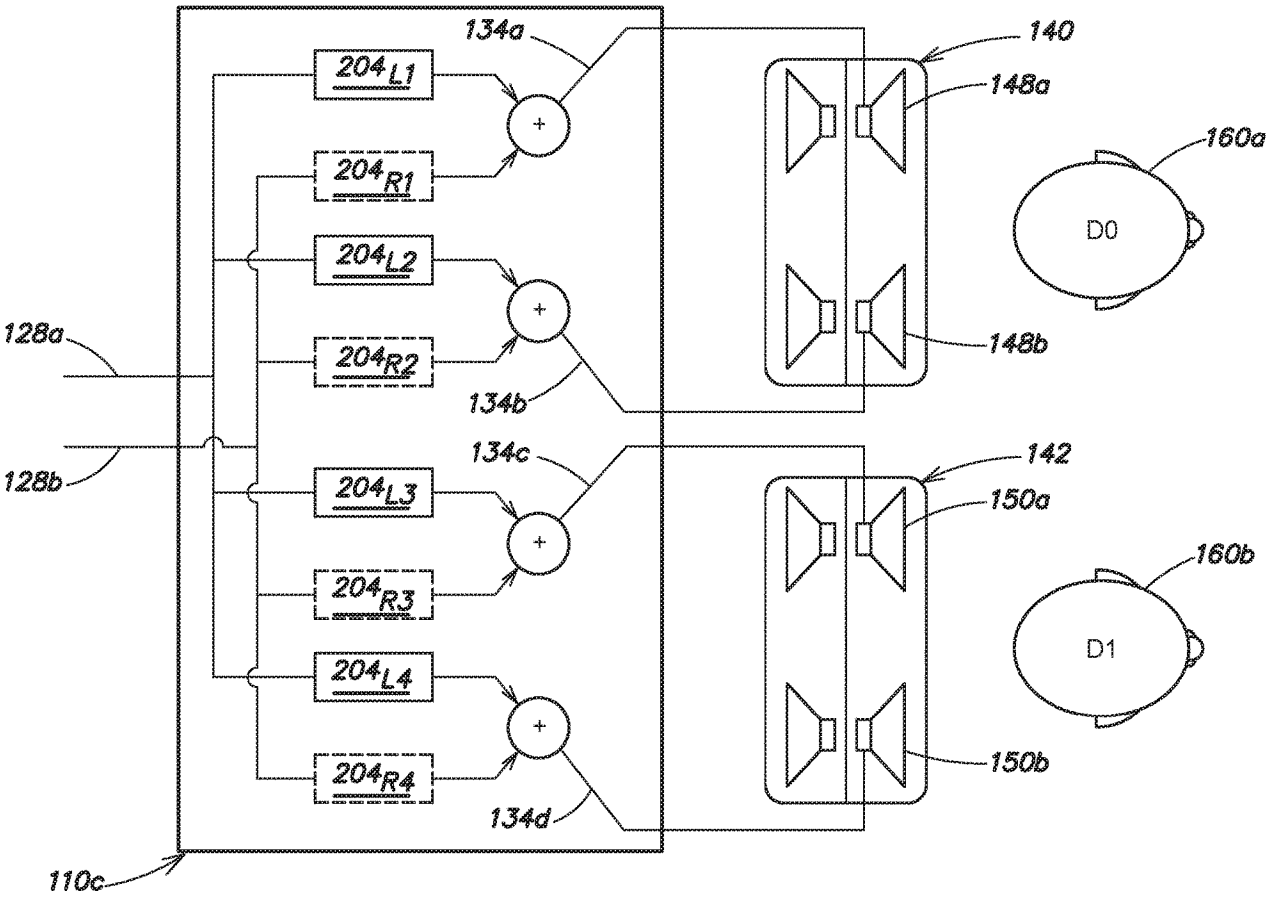

Referring to FIG. 2C, with continuing reference to FIG. 1, the third cross-talk cancellation filter block 110*c* includes a plurality of cross-talk cancellation filters (eight shown). The second amplitude adjusted audio signal 128, shown as a stereo audio signal including left and right audio channels 128*a*, 128*b*, is passed through the third cross-talk cancellation filter block 110*c* to produce third filtered audio signals 134*a-d* (collectively referenced as 134), one for each of the forward firing speakers 148*a*, 148*b*, 150*a*, 150*b* in the front headrests 140, 142. These filtered audio signals 134 determine the net acoustic energy associated with each acoustic channel in the second audio signal 120 that is provided to the occupants in the front seats.

A left channel filter $\mathbf{204}_{L1}$ associated with a forward firing left speaker 148*a* of the headrest 140 modifies the left channel input signal 128*a* taking into account the acoustic transfer functions from each of the rear headrest near-field mounted speakers 156*a*, 156*b*, 158*a*, 158*b* (FIG. 1) and from each of the other forward firing front headrest mounted near-field speakers 148*b*, 150*a*, 150*b* to an expected position of the occupant D0's left ear to produce a first output signal component that is configured to cancel the left channel audio content of the second audio signal 120 that is leaked to the occupant D0's left ear from the rear headrest mounted speakers 156*a*, 156*b*, 158*a*, 158*b* and from the other forward firing front headrest mounted speakers 148*b*, 150*a*, 150*b*.

A right channel filter $\mathbf{204}_{R1}$ associated with the forward firing left speaker 148*a* of the 140 modifies the right channel input 128*b* from the second amplitude adjusted audio signal 128 taking into account the acoustic transfer functions from each of the rear headrest mounted speakers 156*a*, 156*b*, 158*a*, 158*b* and from each of the other forward firing front headrest mounted speakers 148*b*, 150*a*, 150*b* to the expected position of the occupant D0's left ear to produce a second output signal component that is configured to cancel the right channel audio content of the second audio signal 120 that is leaked to the occupant D0's left ear from the rear headrest mount speakers 156*a*, 156*b*, 158*a*, 158*b* and from the other forward firing front headrest mounted speakers 148*b*, 150*a*, 150*b*.

The first and second output signal components are combined to produce a filtered audio signal 134*a* which is provided to the front firing left speaker 148*a* in the occupant D0's headrest 140. The remaining cross-talk cancellation filters of the third cross-talk cancellation filter block 110*c* and the associated speakers 148*b*, 150*a*, 150*b* operate similarly so that audio content from the second audio signal 120 is cancelled at the seating positions in the front audio content zone 101*a* (FIG. 1).

Filters $\mathbf{204}_{L2}$ and $\mathbf{204}_{R2}$ provide a filtered audio signal 134*b* to the front firing right speaker 148*b* in the headrest 140, which is transduced to cancel audio content of the second audio signal 120 leaked by the other front headrest mounted speakers 148*a*, 150*a*, 150*b* and the rear headrest mounted speakers 156*a*, 156*b*, 158*a*, 158*b* at the occupant D0's right ear.

Filters $\mathbf{204}_{L3}$ and $\mathbf{204}_{R3}$ provide a filtered audio signal 134*c* to the front firing left speaker 150*a* in the headrest 142, which is transduced to cancel audio content of the second audio signal 120 leaked by the other front headrest mounted speakers 148*a*, 148*b*, 150*b* and the rear headrest mounted speakers 156*a*, 156*b*, 158*a*, 158*b* at the occupant D1's left ear.

Filters $\mathbf{204}_{L4}$ and $\mathbf{204}_{R4}$ provide a filtered audio signal 134*d* to the front firing right speaker 150*b* in the headrest 142, which is transduced to cancel audio content of the second audio signal 120 leaked by the other front headrest mounted speakers 148*a*, 148*b*, 150*a* and the rear headrest mounted speakers 156*a*, 156*b*, 158*a*, 158*b* at the occupant D1's right ear.

Figure 2D:
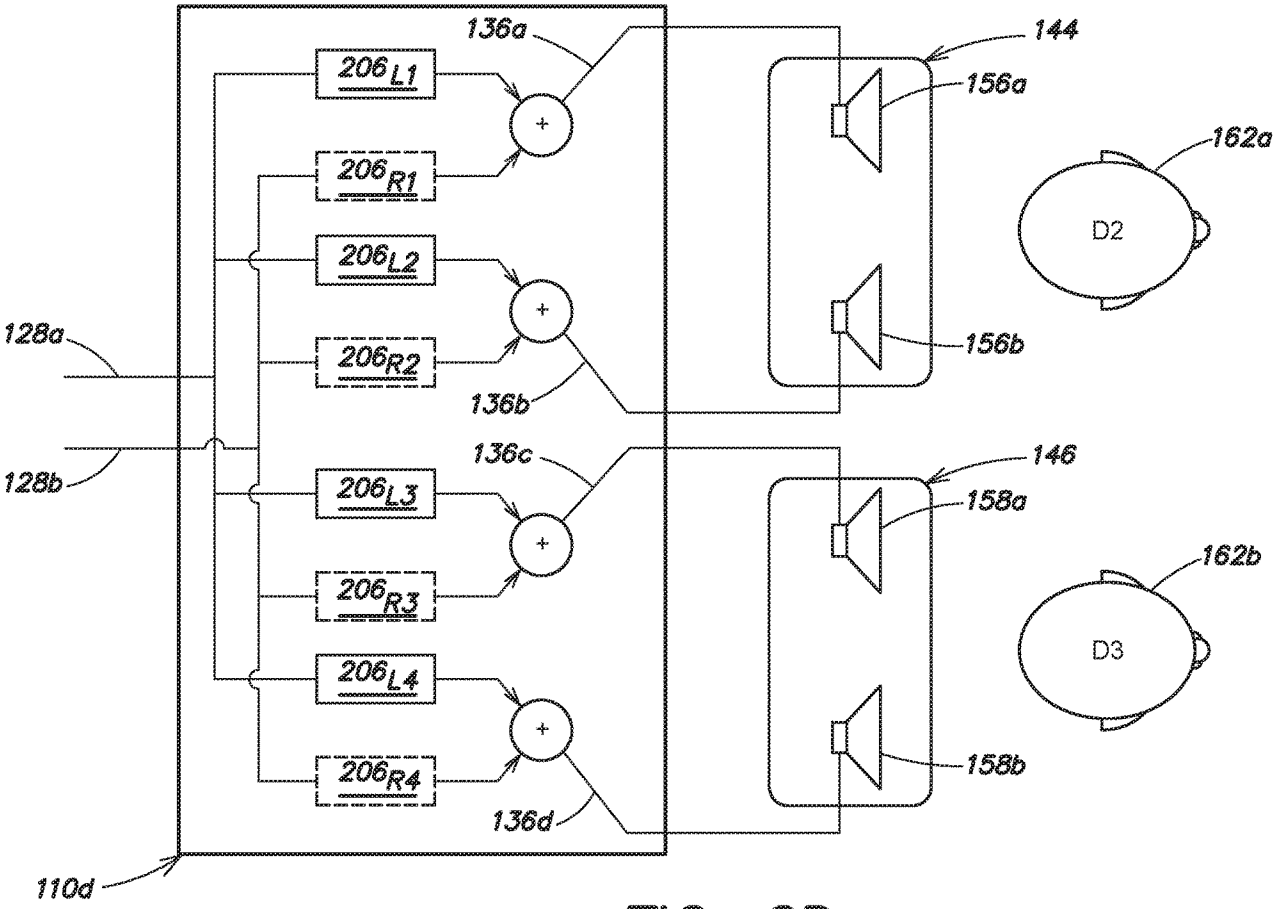

Referring to FIG. 2D, with continuing reference to FIG. 1 the fourth cross-talk cancellation filter 110*d* block includes a plurality of cross-talk cancellation filters (eight shown). The second amplitude adjusted audio signal 128, shown again as a stereo audio signal consisting of left and right audio channels 128*a*, 128*b*, is passed through the fourth cross-talk cancellation filter block 110*d* to produce fourth filtered audio signals 136*a-d* (collectively referenced as 136), one for each of the speakers 156*a*, 156*b*, 158*a*, 158*b* in the rear headrests 144, 146. These filtered audio signals 136 determine the net acoustic energy associated with each acoustic channel in the second audio signal 120 that is provided to the occupants in the rear seats.

A left channel filter $\mathbf{206}_{L1}$ associated with a left speaker 156*a* of the headrest 144 modifies the left channel input signal 128*a* taking into account the acoustic transfer functions from each of the other rear headrest mounted speakers 156*b*, 158*a*, 158*b* and the forward firing speakers 148*a*, 148*b*, 150*a*, 150*b* (FIG. 1) of the front headrests 140, 142 (FIG. 1) to an expected position of the occupant D2's left ear to produce a first output signal component that is configured to reproduce the left channel audio content of the second audio signal 120 at the occupant D2's left ear.

A right channel filter $\mathbf{206}_{R1}$ associated with the left speaker 156*a* of the rear left passenger's headrest 144 modifies the right channel input 128*b* from second amplitude adjusted audio signal 128 taking into account the acoustic transfer functions from each of the other rear headrest mounted speakers 156*b*, 158*a*, 158*b* and the forward firing speakers 148*a*, 148*b*, 150*a*, 150*b* of the front headrests 140, 142 to the expected position of the occupant D2's left ear to produce a second output signal component that is configured to cancel the right channel audio content of the second audio signal 120 that is leaked to the occupant D2's left ear from the other speakers in the rear headrests 156*b*, 158*a*, 158*b* and from the forward firing speakers 148*a*, 148*b*, 150*a*, 150*b* mounted in the front headrests 140, 142.

The first and second output signal components are combined to produce a filtered audio signal 136*a* which is provided to the left speaker 156*a* in the headrest 144. The remaining cross-talk cancellation filters of the fourth cross-talk cancellation filter block 110*d* and the associated speakers 156*b*, 158*a*, 158*b* operate similarly so that the occupants of the third seating position 162*a* and fourth seating position 162*b* hear only left audio content of the second audio signal 120 at their respective left ears and hear only right audio content of the second audio signal 120 at their respective right ears.

Filters $\mathbf{206}_{L2}$ and $\mathbf{206}_{R2}$ provide a filtered audio signal 136*b* to the right speaker 156*b* in the headrest 144, which is transduced to reproduce the right channel audio content of the second audio signal 120 at the occupant D2's right ear, while cancelling left channel content of the second audio signal 120 leaked by the forward firing front headrest mounted speakers 148*a*, 148*b*, 150*a*, 150*b* and the other rear headrest mounted speakers 156*b*, 158*a*, 158*b* at the occupant D2's right ear.

Filters $\mathbf{206}_{L3}$ and $\mathbf{206}_{R3}$ provide a filtered audio signal 136*c* to the left speaker 158*a* in the headrest 146, which is transduced to reproduce the left channel audio content of the second audio signal 120 at the occupant D3's left ear, while cancelling right channel content of the second audio signal 120 leaked by the forward firing front headrest mounted speakers 148*a*, 148*b*, 150*a*, 150*b* and the other rear headrest mounted speakers 156*a*, 156*b*, 158*b* at the occupant D3's left ear.

Filters $\mathbf{206}_{L4}$ and $\mathbf{206}_{R4}$ provide a filtered audio signal 136*d* to the forward firing right speaker 158*b* in the headrest 146, which is transduced to reproduce the right channel audio content of the second audio signal 120 at the occupant D3's right ear, while cancelling left channel content of the second audio signal 120 leaked by the forward firing front headrest mounted speakers 148*a*, 148*b*, 150*a*, 150*b* and the other rear headrest mounted speakers 156*a*, 156*b*, 158*a* at the occupant D3's right ear.

The above described audio system 100 can allow rear vehicle occupants (a/k/a rear passengers), i.e., occupants in the rear seating positions 162*a*, 162*b*, to listen to different audio content than the occupants in the front seating positions 160*a*, 160*b*. The system 100 can also allow both sets of occupants (i.e., front and back) to listen to the same audio content at contrasting volumes level. For example, passengers in the rear seating positions 162*a*, 162*b* may wish to listen to the same audio content as the occupants in the front seating positions 160*a*, 160*b*, but at a low volume level.

When the volume difference between zones becomes large (>~6 dB), there may be some spectral coloring in the attenuated zone (i.e., the lower volume zone) because of the relatively poorer isolation at higher frequencies. This may be particularly noticeable when the same audio content is presented in both audio content zones. In some cases, to inhibit such spectral coloring, lower frequencies may be attenuated less than higher frequencies in the attenuated zone, which can help to flatten the acoustic energy in the attenuated zone (i.e., to maintain a substantially balanced spectrum) to provide a user experience that feels more like regular volume control.

Accordingly, during a first mode of operation, each of the forward firing speakers 148*a*, 148*b*, 150*a*, 150*b* of the front headrests 140, 142, the rear firing speakers 152*a*, 152*b*, 154*a*, 154*b* of the front headrests 140, 142, and the forward firing speakers 156*a*, 156*b*, 158*a*, 158*b* of the rear headrests 144, 146 may be controlled to provide an improved listening experience to a corresponding seating position. Various other examples of cross-talk filters and near-field speakers configured to provide filtered audio content to a proximate seating position are further described in commonly owned U.S. patent application Ser. No. 14/828,991, filed Aug. 18, 2015, titled "Audio Systems for Providing Isolated Listening Zones," which is incorporated herein by reference in its entirety.

In certain other examples, each of the near-field speakers within the audio system 100 may also be driven to provide an improved listening experience at another seating position within the vehicle cabin. For instance, referring to FIG. 1, system 100 may dynamically reconfigure one or more of the cancellation filter blocks 110*a-d* based on a loading within the vehicle cabin 103 to drive the corresponding speakers to focus cancelling acoustic energy at a desired location. Such operations are performed during a second mode of operation. During operation of the audio system 100, the system 100 may automatically or dynamically reconfigure each near-field speaker between the first mode of operation and the second mode of operation, or vice versa.

It is appreciated that within enclosed spaces (such as the vehicle cabin 130) the acoustic energy provided by a near-field speaker may reflect from surfaces proximate the near-field speaker, and may be undesirably leaked to other seating positions. This is often the case when one seating position is in a forward or rearward facing direction of the seating position that is intended to receive the acoustic energy. For example, the audio content provided by the forward firing near-field speakers 156*a*, 156*b* may be undesirably leaked and received by the occupant D0 at the first seating position 160*a* and the occupant D1 at the second seating position 160*b*.

Accordingly, in certain examples the near-field speakers corresponding to a vacant seating position may be leveraged by the audio system 100 to provide cancelling acoustic energy which destructively interferes with the leaked acoustic energy at the unintended location. That is, the system 100 may drive the near-field speakers corresponding to a vacant seating position to provide cancelling acoustic energy at another location instead of providing audio content to the vacant seating position. Vacancy or occupancy indications (shown generally as signal 164) of the one or more seating positions may be received from one or more sensors 166*a-d* via a sensor interface of the control circuitry 114 or may be manually set by a user. Each vacancy or occupancy indication may designate which near-field speakers are available for noise cancellation by way of the second mode of operation.

As illustrated in FIG. 1, the audio system 100 may include one or more sensors (i.e. sensors 166*a-d*) each positioned proximate a seating position within the vehicle cabin 103. In response to receiving an indication from a sensor, the control circuitry 114 may adjust the front and rear volume adjustment circuitry 106*a*, 106*b* and/or the one or more cross-talk cancellation filters within the filter blocks 110*a-d* to provide an adjusted filtered audio signal. In particular, responsive to receiving an occupancy signal indicating that a particular seating position is vacant, the control circuitry 114 may adjust one or more coefficients of the transfer function of the cross-talk cancellation filters corresponding to the near-field speaker(s) for that vacant seating position such that the corresponding near-field speaker provides cancelling acoustic energy. For example, responsive to receiving a sensor input indicating that the fourth seating position 162*b* is vacant, the control circuitry 114 may modify a coefficient of the transfer functions of the plurality of cross-talk cancellation filters of cancellation filter block 110*d*, which provides a filtered audio signal to the forward firing near-field speakers 156*a*, 156*b*, 158*a*, 158*b*.

In various implementations, the one or more sensors 166*a-d* shown in FIG. 1 may include one or more sensors positioned within or around the vehicle seat of a seating position. For example, the one or more sensors 166*a-d* may include a pressure sensor, an optical sensor, or any other suitable sensor device. In some cases, sensor inputs may be obtained at the control circuitry 114 via a sensor interface of the control circuitry 114. Cross-talk cancellation filter transfer function coefficients may be predetermined based on transfer function measurements taken with varying occupancy configurations of the vehicle cabin 103 and other characteristics of the environment discussed herein. The coefficients for the different occupancy configurations may be stored in a look-up table accessible to the control circuitry 114. The look-up table may include any array that replaces a runtime computation with an indexing operation. For example, the look-up table may include an array of pre-calculated and indexed transfer function coefficients stored in static program storage.

In certain implementations, the control circuitry 114 may include a single controller; however, in various other examples the control circuitry 114 may consist of a plurality of controllers and/or control circuitry. While the control circuitry 114 is illustrated separate from one or more components of the audio system 100, in various examples, the control circuitry 114 may be combined with one or more other components, such as the audio signal processing circuitry 104, the volume adjustment circuitry 106*a*, 106*b*, and the one or more cancellation filters blocks 110*a-d*. For instance, the control circuitry 114, audio signal processing circuitry 104, the volume control adjustment circuitry 106*a*, 106*b*, and the one or more cancellation filters 110, may include a combination of software-configured elements, application specific integrated circuitry, or any combination of various hardware and logic circuitry for performing the various processes discussed herein.

In various examples, the control circuitry 114 includes a processor, data storage, a user interface, and one or more interfaces for system components, such as a sensor interface, and a communication interface. The processor may be coupled to the data storage, the communication interface, and the one or more other interfaces, and be configured to perform a series of instructions that result in manipulated data stored and retrieved from the data storage. The processor may include a commercially available processor, such as a processor manufactured by INTEL, AMD, MOTOROLA, or FREESCALE.

In additional examples, the processor may be configured to execute an operating system. The operating system may provide platform services to application software. These platform services may include inter-process and network communication, file system management, and standard database manipulation. One or more of many operating systems may be used, and examples are not limited to any particular operating system or operating system characteristic. In some examples, the processor may be configured to execute a real-time operating system (RTOS), such as RTLinux, or a non-real time operating system, such as BSD or GNU/Linux.

The instructions stored on the data storage may include executable programs or other code that can be executed by the processor. The instructions may be persistently stored as encoded signals, and the instructions may cause the processor to perform the functions and processes described herein, such as providing one or more control signals to adjust a transfer function coefficient. The data storage may include information that is recorded, on or in, the medium, and this information may be processed by the processor during execution of instructions. The data storage includes a computer readable and writeable nonvolatile data storage medium configured to store non-transitory instructions and data. In addition, the data storage includes processor memory that stores data during operation of the processor.

Referring again to FIG. 2D, with continuing reference to the audio system 100 of FIG. 1, in response to receiving an occupancy signal indicating that the seating position of occupant D3 is vacant (i.e., the fourth seating position 162*b*), the control circuitry 114 may adjust a coefficient of the filters $\mathbf{206}_{L3}$, $\mathbf{206}_{R3}$, $\mathbf{206}_{L4}$, $\mathbf{206}_{R4}$ to focus cancelling acoustic energy at the seating position of the occupant D0 (i.e., the first seating position 160*a*), thereby to provide enhanced cancellation of audio content associated with the second audio signal 120 at seating position 160*a* (i.e., beyond that which is provided via speakers 148*a*, 148*b* and filters $\mathbf{204}_{L1}$, $\mathbf{204}_{R1}$, $\mathbf{204}_{L2}$, $\mathbf{204}_{R2}$). Specifically, the left and right audio channels 128*a*, 128*b*, are passed through the adjusted cross-talk cancellation filters $\mathbf{206}_{L3}$, $\mathbf{206}_{R3}$, $\mathbf{206}_{L4}$, $\mathbf{206}_{R4}$ to produce filtered audio signals 136*c*, 136*d*, one for each of the near-field speakers 158*a*, 158*b* in the rear headrest 146. During the second mode of operation, the filtered audio signals 136*c*, 136*d* may determine the net acoustic energy associated with substantially reducing the net acoustic energy of each acoustic channel in the second audio signal 120 that is leaked to the occupant of the first seating position 160*a* (and/or the front audio content zone 101*a*) from at least the near field speakers 156*a*, 156*b*.

Similarly, in response to receiving an occupancy signal indicating that the seating position of the occupant D2 is vacant (i.e., the third seating position 162*a*), the control circuitry 114 may adjust a coefficient of the filters $\mathbf{206}_{L1}$, $\mathbf{206}_{R1}$, $\mathbf{206}_{L2}$, $\mathbf{206}_{R2}$ to focus cancelling acoustic energy at the seating position of the occupant D1 (i.e., the second seating position 160*b*). Specifically, the left and right audio channels 128*a*, 128*b*, are passed through the adjusted cross-talk cancellation filters $\mathbf{206}_{L1}$, $\mathbf{206}_{R1}$, $\mathbf{206}_{L2}$, $\mathbf{206}_{R2}$ to produce filtered audio signals 136*a*, 136*b*, one for each of the near-field speakers 156*a*, 156*b* in the rear headrest 144. During the second mode of operation, the filtered audio signals 136*a*, 136*b* may determine the net acoustic energy associated with substantially reducing the net acoustic energy of each acoustic channel in the second audio signal 120 that is leaked to the occupant of the second seating position 160*b* (and/or the front audio content zone 101*a* from the near-field speakers 158*a*, 158*b*). In other cases, such as when seating position 160*b* is unoccupied, the speakers associated with headrest 142 (e.g., (e.g., speakers 150*a*, 150*b*) can be used to provide for enhanced attenuation of energy (e.g., low frequency energy) that is leaked to the rear seating positions 162*a*, 162*b* from the front zone 101*a*.

In a further example, referring again to FIG. 2B with continuing reference to the audio system 100 of FIG. 1, in response to receiving an indication that the seating position of the occupant D3 is vacant (i.e., the fourth seating position 162*b*) the control circuitry 114 may adjust a coefficient of the filters $\mathbf{202}_{L3}$, $\mathbf{202}_{R3}$, $\mathbf{204}_{L4}$, $\mathbf{202}_{R4}$ to focus cancelling acoustic energy at the seating position of occupant D2 (i.e., the third seating position 162*a*). Specifically, the left and right audio channels 126*a*, 126*b*, are passed through the adjusted cross-talk cancellation filters $\mathbf{202}_{L3}$, $\mathbf{202}_{R3}$, $\mathbf{202}_{L4}$, $\mathbf{202}_{R4}$ to produce filtered audio signals 132*c*, 132*d*, one for each of near-field speakers 154*a*, 154*b* in the front headrest 142. During the second mode of operation, the filtered audio signals 132*c*, 132*d* may determine the net acoustic energy associated with substantially reducing the net acoustic energy of each acoustic channel in the first audio signal 118 that is leaked to the occupant of the third seating position 162*a* and/or the rear audio content zone 101*b* from the near-field speakers 148*a*, 148*b*.

Similarly, in response to receiving an indication that the seating position of occupant D2 is vacant (i.e., the third seating position 162*a* in FIG. 1) the control circuitry 114 may adjust a coefficient of the filters $\mathbf{202}_{L1}$, $\mathbf{202}_{R1}$, $\mathbf{202}_{L2}$, $\mathbf{202}_{R2}$ to focus cancelling acoustic energy at the seating position of occupant D3 (i.e., the fourth seating position 162*b* in FIG. 1). Specifically, the left and right audio channels 126*a*, 126*b*, are passed through the adjusted cross-talk cancellation filters $\mathbf{202}_{L1}$, $\mathbf{202}_{R1}$, $\mathbf{202}_{L2}$, $\mathbf{202}_{R2}$ to produce filtered audio signals 132*a*, 132*b*, one for each of near-field speakers 152*a*, 152*b* in the front headrest 140. During the second mode of operation, the filtered audio signals 132*a*, 132*b* may determine the net acoustic energy associated with substantially reducing the net acoustic energy of each acoustic channel in the second audio signal 118 that is leaked to the occupant of the third seating position 162*a* (and/or the rear audio content zone 101*b* from the near-field speakers 150*a*, 150*b*.

In particular examples, the acoustic energy provided by a near-field speaker and leaked to an undesired location may include at least a high frequency portion and a low frequency portion (e.g., the acoustic energy leaked from the near-field speakers 156*a*, 156*b* to the first seating position 160*a*). In such an example, the one or more near-field speakers proximate a vacant seating position may provide cancelling acoustic energy to substantially cancel a certain frequency range of the acoustic energy leaked. For instance, the high frequency portion may be within a frequency range of 500 Hz to 5,000 Hz and the low frequency portion may be within a frequency range of 150 Hz to 500 Hz. Providing cancelling acoustic energy to substantially cancel at least a portion of the acoustic energy leaked to another seating position may include substantially cancelling the low frequency portion of the acoustic energy. A frequency range including the high frequency portion of the leaked acoustic energy may be substantially reduced by one or more volume control functions performed by other components of the audio system 100, such as the volume adjustment circuitry 106*b*.

While discussed herein as substantially cancelling, reducing, or substantially cancelling a portion of, acoustic energy leaked to an undesired location, it is appreciated that the level of acceptable leaked acoustic energy will largely vary based on the application, the level of performance of the given system, and/or the level of sensitivity of a particular occupant. Accordingly, while in at least one example cancelling a portion of the leaked acoustic energy may include cancelling all or most of the leaked acoustic energy, in various other examples, it may include cancelling only a small fraction of the leaked acoustic energy.

While discussed with reference to the example audio system 100 of FIG. 1 and FIGS. 2A-2D as including a "front" audio content zone 101*a* and a "rear" audio content zone 101*b*, and a "first", "second", "third", and "fourth" seating position 160*a*, 160*b*, 162*a*, 162*b*, such aspects and implementations of the audio system 100 may be arranged in orientations other than those shown in the illustrated examples. That is, while in one example the first seating position 160*a* and the second seating position 160*b* are in a forward facing direction relative to the third seating position 162*a* and the fourth seating position 162*b*, in various other implementations, the first seating position 160*a* and the second seating position 160*b* may be in a rearward facing direction of the third seating position 162*a* and the fourth seating position 162*b*. Accordingly, in various other implementations, the various seating positions may be positioned different locations from those shown in FIG. 1 and FIGS. 2A-2D.

As described above, several examples perform processes for controlling acoustic isolation and providing an improved listening experience for an occupant of a seating position. In some examples, these processes are executed by an audio system, such as the system 100 described above with reference to at least FIG. 1. One example of such a process is illustrated in FIG. 3.

Figure 3:
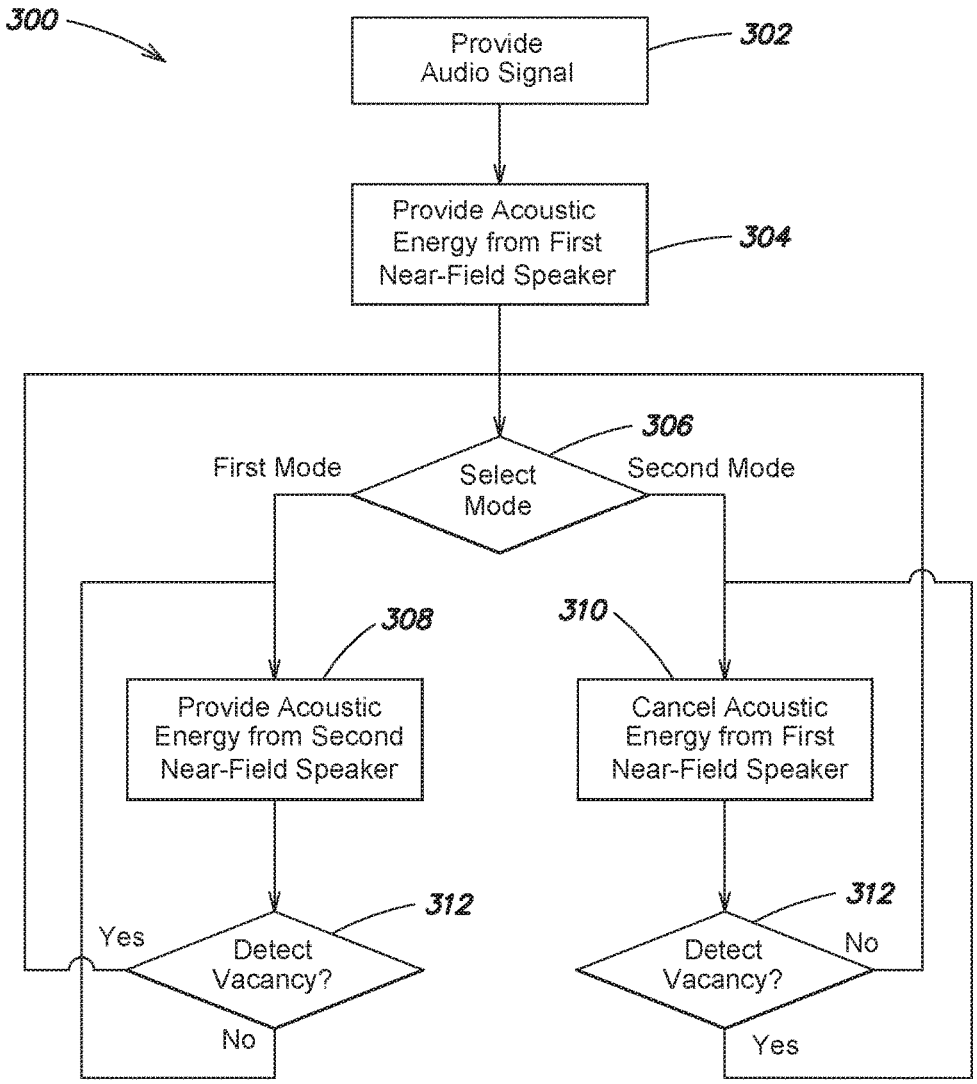
FIG. 3 is an example process flow for acoustic isolation according to aspects of the disclosure.

According to the example illustrated in FIG. 3, the process 300 may include the acts of providing an audio signal, providing acoustic energy from a first near-field speaker, selecting between at least a first mode of operation and a second mode of operation, and in the first mode of operation, providing acoustic energy from a second near-field speaker, and in the second mode of operation, cancelling at least a portion of the acoustic energy from the first near-field speaker. FIG. 3 is discussed within continuing reference to the example audio system 100 illustrated in FIG. 1 and FIGS. 2A-2D.

In act 302, the process 300 includes providing an audio signal from the audio source(s) 102. The one or more audio signals may be provided and received at the audio signal processing circuitry 104. As discussed herein, each audio content zone 101*a*, 101*b* can select a different audio source. However, in certain examples a common audio source may be selected for both of the front and rear audio content zones 101*a*, 101*b*. In various examples, the audio signal processing circuitry 104 delivers a first audio signal to the front volume adjustment circuitry 106*a* and a second audio signal to the rear volume adjustment circuitry 106*b*. Often, this includes the first audio signal 118 representing audio content for the front zone 101*a* and the second audio signal 120 representing audio content for the rear zone 101*b*.

In various examples, the process 300 may further include receiving control in from a user to select a particular audio source for each audio content zone. Such an act may include receiving a user input at a user interface of the control circuity 114 indicating the desired audio source for each audio content zone. Responsive to receiving the selection, the control circuitry 114 may provide one or more signals to the audio signal processing circuitry 104 to initiate the audio signal provisioning act.

Once received, the volume adjustment circuitry 106*a*, 106*b* adjusts the respective amplitude of the received audio signal and provides the amplitude adjusted audio signal to the corresponding cross-talk cancellation filter block. In that regard, the front volume adjustment circuitry 106*a* controls volume of audio content presented in the front audio content zone 101*a*, and the rear volume adjustment circuitry 106*b* operates to control the volume of audio content presented in the rear audio content zone 101*b*.

In act 304, the process 300 further includes receiving the audio signal at a first near-field speaker and providing acoustic energy from the first near-field speaker to a seating position proximate that speaker. For example, the process 300 may include providing acoustic energy (e.g., music content) to the third seating position 162*a* from the forward firing near-field speakers 156*a*, 156*b* in the rear headrest 144. As discussed above, while each near-field speaker is intended to provide acoustic energy to the seating position proximate that near-field speaker, it is appreciated that within enclosed spaces (such as the vehicle cabin) the provided acoustic energy may reflect from surfaces proximate the near-field speakers, and may be undesirably leaked to other seating positions. For example, the music content provided by the near-field speakers 156*a*, 156*b* may undesirably leaked to at least the first seating position 160*a*.

While in some instances, recipients of the leaked acoustic energy may enjoy receiving audio content intended for other listeners, generally, the leaked acoustic energy is an inconvenience for those unintended recipients. For example, during extended periods of time within a vehicle, occupants within the front of the vehicle may grow tired of listening to a movie soundtrack delivered to occupants in the rear of the vehicle. Accordingly, in various examples the process 300 includes the acts of providing a filtered audio signal to a near-field speaker positioned proximate another seating position, and cancelling, at the undesired seating position, at least a portion of the leaked acoustic energy based at least in part on the filtered audio signal (act 310).

In act 306, the process 300 may include selecting between a first mode of operation and a second mode of operation. In the first mode of operation (act 308), the process 300 includes providing acoustic energy from a second near-field speaker to a seating position positioned proximate the second near-field speaker. For example, during the first mode of operation the process 300 may include providing acoustic energy to the fourth seating position 162*b* from the forward firing near-field speakers 158*a*, 158*b* within the rear headrest 146. As discussed with reference to at least FIG. 1, during the first mode of operation, each speaker may also operate to provide cross-talk cancellation functionality at the corresponding seating position. For example, in the first mode of operation, the near-field speakers 158*a*, 158*b* may provide acoustic energy to the fourth seating position 162*b*, and may be driven to substantially cancel leaked acoustic energy received at the fourth seating position 106*d* from any of the other near-field speakers.

In the second mode of operation (act 310), the process 300 may include cancelling, at another seating position, at least a portion of the acoustic energy leaked from the first near-field speaker with cancelling acoustic energy provided by the second near-field speaker. For example, in act 310 the process 300 may include updating a coefficient of one or more of the cross-talk cancellation filters within one of the filter blocks 110*a-d* to provide a filtered audio signal to focus cancelling acoustic energy at a desired location. Responsive to adjusting the cancellation filter and providing the filtered audio signal to the second near-field speaker, corresponding cancelling acoustic energy may be radiated to destructively interfere with the leaked acoustic energy from the first near-field speaker. For example, near-field speakers 158*a*, 158*b* may receive filtered audio signals and radiate cancelling acoustic energy to help cancel, at the first seating position 160*a*, the leaked acoustic energy provided from the near-field speakers 156*a*, 156*b*.

As discussed above with reference to at least FIG. 1, in various examples the mode of operation of a given near-field speaker may be based at least in part on a vacancy or occupancy of the corresponding seating position. Accordingly, in certain examples, the process 300 may include detecting or receiving a selection that at least one of a vacancy and an occupancy of a seating position, and providing a corresponding occupancy signal. Act 312 is illustrated in FIG. 3 as including the act of detecting a seating position vacancy; however, in certain other examples similar sensors may be placed to detect a seating position occupancy.

Referring to the first mode of operation, if a vacancy is not detected (i.e., an occupancy is detected), the process 300 may include continuing the first mode of operation. However, if while operating in the first mode of operation a vacancy is detected (i.e., an occupancy is not detected), the process 300 may include switching to the second mode of operation. In contrast, referring to the second mode of operation, if a vacancy is not detected (i.e., an occupancy is detected), the process 300 may include switching to the first mode of operation. Whereas, if in the second mode of operation, a vacancy is detected (i.e., an occupancy is not detected), the process 300 may include continuing the second mode of operation.

In various examples, the process may further include certain other acts not shown or discussed with reference to FIG. 3. Such acts and processes may include those performed by components of the audio system 100 and discussed with reference FIGS. 1, 2A, and 2B.

Having described above several aspects of at least one implementation, it is to be appreciated various alterations, modifications, and improvements will readily occur to those skilled in the art. Such alterations, modifications, and improvements are intended to be part of this disclosure and are intended to be within the scope of the description. Accordingly, the foregoing description and drawings are by way of example only, and the scope of the disclosure should be determined from proper construction of the appended claims, and their equivalents.

What is claimed is:

1. An audio system comprising:

at least one audio signal source;

a first near-field speaker coupled to the at least one audio signal source and positioned proximate a first seating position;

a second near-field speaker coupled to the at least one audio signal source and positioned proximate a second seating position, the second near-field speaker being configured to provide acoustic energy to the second seating position based on an audio signal provided by the at least one audio signal source;

a third near-field speaker coupled to the at least one audio signal source and positioned proximate a third seating position, the third near-field speaker being configured to provide acoustic energy to the third seating position based on the audio signal provided by the at least one audio signal source, during a first mode of operation; and at least one cancellation filter interposed between the at least one audio signal source and the third near-field speaker, the at least one cancellation filter being configured to provide a filtered audio signal to the third near-field speaker, during a second mode of operation, to cancel at the first seating position at least a portion of the acoustic energy provided by the second near-field speaker.

2. The audio system of claim 1, further comprising:

at least one sensor positioned to detect at least one of a vacancy and an occupancy of the third seating position and provide a corresponding occupancy signal; and control circuitry coupled to the at least one sensor and configured select between the first mode of operation and the second mode of operation based at least in part on the occupancy signal.

3. The audio system of claim 2, wherein the control circuitry is configured to dynamically switch between the first mode of operation and the second mode of operation based on the detected vacancy of the third seating position, and wherein the control circuitry is configured to dynamically switch between the second mode of operation and the first mode of operation based on the detected occupancy of the third seating position.

4. The audio system of claim 1, wherein in the second mode of operation the third near-field speaker is configured to receive the filtered audio signal and radiate cancelling acoustic energy such that the acoustic energy provided by the second near-field speaker and the cancelling acoustic energy destructively interfere at the first seating position.

5. The audio system of claim 4, wherein the at least one cancellation filter includes at least one linear and time-invariant filter defined by a transfer function.

6. The audio system of claim 5, wherein the acoustic energy provided by the second near-field speaker includes at least a high frequency portion and a low frequency portion, and wherein the canceled portion of the acoustic energy provided by the second near-field speaker is the low frequency portion.

7. The audio system of claim 6, wherein the at least one cancellation filter is configured such that, in the second mode of operation, the third near-field speaker does not produce acoustic energy in a high frequency range associated with the high frequency portion.

8. The audio system of claim 1, wherein the first seating position is located within a first audio content zone, the second seating position is located within a second audio content zone, and the third seating position is located within the second audio content zone, and wherein the second audio content zone is within one of a forward-facing direction or rearward-facing direction of the first audio content zone.

9. The audio system of claim 8, wherein the first seating position includes a first seat within a vehicle, the second seating position includes a second seat within the vehicle, and the third seating position includes a third seat within the vehicle.

10. The audio system of claim 9, wherein the first seat includes a driver's seat positioned within a first row of seats of the vehicle, the second seat includes a first rear passenger's seat positioned within a second row of seats of the vehicle, and the third seat includes a second rear passenger's seat positioned within the second row of seats of the vehicle.

11. The audio system of claim 9, wherein the first seat includes a first rear passenger's seat positioned within a second row of seats of the vehicle, the second seat includes a front passenger's seat positioned within a first row of seats of the vehicle, and the third seat includes a driver's seat positioned within the first row of seats of the vehicle.

12. An audio system comprising:

a first audio signal source;

a first near-field speaker coupled to the audio signal source and positioned within a first audio content zone;

a second audio signal source;

a second near-field speaker and a third near-field speaker each coupled to the second audio signal source and positioned within a second audio content zone, the second near-field speaker being configured to provide acoustic energy to the second audio content zone based on an audio signal provided by the second audio signal source;

at least one sensor positioned to detect a vacancy of a first seating position within the second audio content zone and proximate the third near-field speaker; and at least one cancellation filter interposed between the second audio signal source and the third near-field speaker, the at least one cancellation filter being configured to provide a filtered audio signal to the third near-field speaker to cancel within the first audio content zone at least a portion of the acoustic energy provided by the second near-field speaker, responsive to detection of the vacancy by the at least one sensor.

13. The audio system of claim 12, wherein the at least one sensor is further configured to detect an occupancy of the first seating position, and wherein the third near-field speaker is further configured to provide acoustic energy to the second audio content zone based on the audio signal provided by the second audio signal source, responsive to detection of the occupancy by the at least one sensor.

14. The audio system of claim 13, wherein the first near-field speaker is configured to provide acoustic energy to the first audio content zone based on the audio signal provided by the first audio signal source, wherein the audio signal provided by the first audio signal source is different from the second audio signal provided by the second audio signal source.

15. The audio system of claim 14, further comprising control circuitry coupled to the at least one sensor and configured to select between a first mode of operation and a second mode of operation based on the detected vacancy or the detected occupancy, wherein in the first mode of operation the third near-field speaker is configured to provide the acoustic energy to the second audio content zone, and wherein in the second mode of operation the third near-field speaker is configured to provide cancelling acoustic energy such that the acoustic energy provided by the second near-field speaker and the cancelling acoustic energy destructively interfere within the first audio content zone.

16. The audio system of claim 12, wherein the acoustic energy provided by the second near-field speaker includes at least a high frequency portion and a low frequency portion, and wherein the canceled portion of the acoustic energy provided by the second near-field speaker is the low frequency portion.

17. The audio system of claim 12, wherein the at least one cancellation filter is configured to provide the filtered audio signal to the third near-field speaker to cancel, at a second seating position within the first audio content zone, the portion of the acoustic energy provided by the second near-field speaker, wherein the second seating position includes a vehicle seat positioned within a first row of seats of a vehicle.

18. The audio system of claim 12, wherein the at least one cancellation filter is configured to provide the filtered audio signal to the third near-field speaker to cancel, at a second seating position within the first audio content zone, the portion of the acoustic energy provided by the second near-field speaker, wherein the second seating position includes a vehicle seat positioned within a second row of seats of a vehicle.

19. A method of operating an audio system, the method comprising:

providing an audio signal;

responsive to receiving the audio signal at a first near-field speaker, providing acoustic energy from the first near-field speaker to a first seating position;

selecting between a first mode of operation and a second mode of operation;

providing acoustic energy from a second near-field speaker to a second seating position positioned proximate the second near-field speaker, during the first mode of operation; and cancelling, at a third seating position, at least a portion of the acoustic energy emitted from the first near-field speaker based at least in part on a filtered audio signal provided to the second near-field speaker, during the second mode of operation.

20. The method according to claim 19, wherein cancelling the at least a portion of the acoustic energy emitted from the first near-field speaker includes providing cancelling acoustic energy from the second near-field speaker such that the acoustic energy provided by the first near-field speaker and the cancelling acoustic energy destructively interfere, at the third seating position.

21. The method according to claim 19, wherein the acoustic energy provided by the first near-field speaker includes at least a high frequency portion and a low frequency portion, and wherein cancelling the at least a portion of the acoustic energy emitted from the first near-field speaker includes cancelling the low frequency portion.

22. The method according to claim 19, further comprising:

detecting at least one of a vacancy and an occupancy of the second seating position; and providing a corresponding occupancy signal, wherein the selection between the first mode of operation and the second mode of operation is based at least in part on the occupancy signal.

23. The method according to claim 22, wherein selecting between the first mode of operation and the second mode of operation includes dynamically switching between the first mode of operation and the second mode of operation based on the detected vacancy of the second seating position.

24. The method according to claim 23, wherein selecting between the first mode of operation and the second mode of operation includes dynamically switching between the second mode of operation and the first mode of operation based on the detected occupancy of the second seating position.

* * * * *